US005292230A

United States Patent [19]

Brown

[11] Patent Number: 5,292,230

[45] Date of Patent: Mar. 8, 1994

[54] CURVATURE STEAM TURBINE VANE AIRFOIL

[75] Inventor: Wilmott G. Brown, Winter Park, Fla.

[73] Assignee: Westinghouse Electric Corp., Pittsburgh, Pa.

[21] Appl. No.: 991,799

[22] Filed: Dec. 16, 1992

[51] Int. Cl.[5] ..... H01D 5/14

[52] U.S. Cl. ..... 416/223 A; 416/DIG. 2; 415/191

[58] Field of Search ..... 416/223 A, DIG. 2; 415/191, 192, 208.1, 208.2

[56] References Cited

U.S. PATENT DOCUMENTS

| | | | |
|---|---|---|---|
| 3,475,108 | 10/1969 | Zickuhr | 416/DIG. 2 |
| 4,080,102 | 3/1978 | Schwab | 416/223 A |
| 4,695,228 | 9/1987 | Purcaru | 416/DIG. 2 |
| 4,900,230 | 2/1990 | Patel | 416/223 A |
| 4,919,593 | 4/1990 | Brown | 416/223 A |
| 4,968,216 | 11/1990 | Anderson et al. | 416/DIG. 2 |
| 5,035,578 | 7/1991 | Tran | 416/223 A |

*Primary Examiner*—Richard A. Bertsch
*Assistant Examiner*—Mark Sgantzos
*Attorney, Agent, or Firm*—G. R. Jarosik

[57] ABSTRACT

A high performance steam turbine vane having a novel airfoil shape. The pressure surface of the airfoil has a substantially straight region proximate the trailing edge that provides the airfoil with adequate thickness to prevent distortion during forging. The novel shape on the suction surface is such that a first region of the suction surface downstream of the gauging point is essentially straight. Traveling in the upstream direction, the first region is followed by a second region that has a large amount of curvature. The second region is followed by a third region that has a lower curvature than the second region. The third region is followed by a fourth region of constantly increasing curvature that increases to a curvature greater than the curvature of the second region. The fourth region is followed by a fifth region, ending at the leading edge, of essentially constant large curvature that includes the maximum curvature throughout the suction surface.

17 Claims, 4 Drawing Sheets

CURVATURE STEAM TURBINE VANE AIRFOIL

BACKGROUND OF THE INVENTION

The present invention relates to vanes for a steam turbine. More specifically, the present invention relates to a high performance vane for use in the latter stages of a steam turbine and having an airfoil portion with improved curvature.

The steam flow path of a steam turbine is formed by a stationary cylinder and a rotor. A large number of stationary vanes are attached to the cylinder in a circumferential array and extend inward into the steam flow path. Similarly, a large number of rotating blades are attached to the rotor in a circumferential array and extend outward into the steam flow path. The stationary vanes and rotating blades are arranged in alternating rows so that a row of vanes and the immediately downstream row of blades forms a stage. The vanes serve to direct the flow of steam so that it enters the downstream row of blades at the correct angle. The blade airfoils extract energy from the steam, thereby developing the power necessary to drive the rotor and the load attached to it.

The amount of energy extracted by each stage depends on the size and shape of the vane and blade airfoils, as well as the quantity of vanes and blades in the stage. Thus, the shapes of the airfoils are an extremely important factor in the thermodynamic performance of the turbine and determining the geometry of the airfoils is a vital portion of the turbine design.

As the steam flows through the turbine its pressure drops through each succeeding stage until the desired discharge pressure is achieved. Thus, the steam properties—that is, temperature, pressure, velocity and moisture content—vary from stage to stage as the steam expands through the flow path. Consequently, each stage employs vanes and blades having an airfoil shape that is optimized for the steam conditions associated with that stage. However, within a given row the vane airfoils are identical.

Generally, the major thermodynamic losses in the vane row occur due to friction losses as the steam flows over the airfoil surface and separation of the boundary layer on the suction surface of the vane. Friction losses are minimized by shaping the airfoil so as to maintain the steam local velocity on the airfoil surface at relatively low values. Separation of the boundary layer is prevented by causing the steam to constantly accelerates as it flows toward the trailing edge of the airfoil. This constant acceleration requires that the passage between adjacent airfoils constantly converges from the vane inlet to the gauging point.

The difficulty associated with designing a steam turbine vane is exacerbated by the fact that the airfoil shape determines, in large part, the mechanical strength of the vane and its resonant frequencies, as well as the thermodynamic performance of the vane. These considerations impose constraints on the choice of vane airfoil shape. Thus, of necessity, the optimum vane airfoil shape for a given row is a matter of compromise between its mechanical and aerodynamic properties. One important constraint involves the thickness of the trailing edge portion of the airfoil. If the trailing edge is too thin, distortion can result in the airfoil as a result of the forging process by which the vanes are manufacture. However, increasing the thickness of the trailing edge can compromise the convergence necessary to prevent steam flow separation.

It is therefore desirable to provide a row of steam turbine vanes having an airfoil shape that provides a sufficiently thick trailing edge region to prevent distortion during forging but which maintains the steam velocity at relatively low values and ensures that the steam does not decelerate as it flows toward the trailing edge.

SUMMARY OF THE INVENTION

Accordingly, it is the general object of the current invention to provide a row of steam turbine vanes having an airfoil shape that provides a sufficiently thick trailing edge region to prevent distortion during forging but which maintains the steam velocity at relatively low values and ensures that the steam does not decelerate as it flows toward the trailing edge.

Briefly, this object, as well as other objects of the current invention, is accomplished in a steam turbine comprising (i) a stationary cylinder for containing a steam flow and a rotor enclosed by the cylinder, (ii) a row of blades attached to the periphery of the rotor, and (iii) a row of vanes supported on the cylinder and disposed upstream of the row of blades, each of the vanes having an airfoil portion having leading and trailing edges and forming a suction surface and a pressure surface between the leading and trailing edges, the airfoil portion having a width in the axial direction and having a cross-sectional shape that, in conjunction with the trailing edge of an adjacent one of the vanes in the row, defines a gauging point on the suction surface. The suction surface has a cross-sectional shape having (i) a first curvature along a first portion downstream of the gauging point, (ii) a second curvature along a second portion upstream of the gauging point, the second curvature being greater than the first curvature, (iii) a third curvature along a third portion upstream of the second portion, the third curvature being less than the second curvature, and (iv) a fourth curvature along a fourth portion upstream of the third portion and ending at the leading edge, the fourth curvature being greater than the third curvature.

DESCRIPTION OF THE PREFERRED EMBODIMENT

Figure 1:
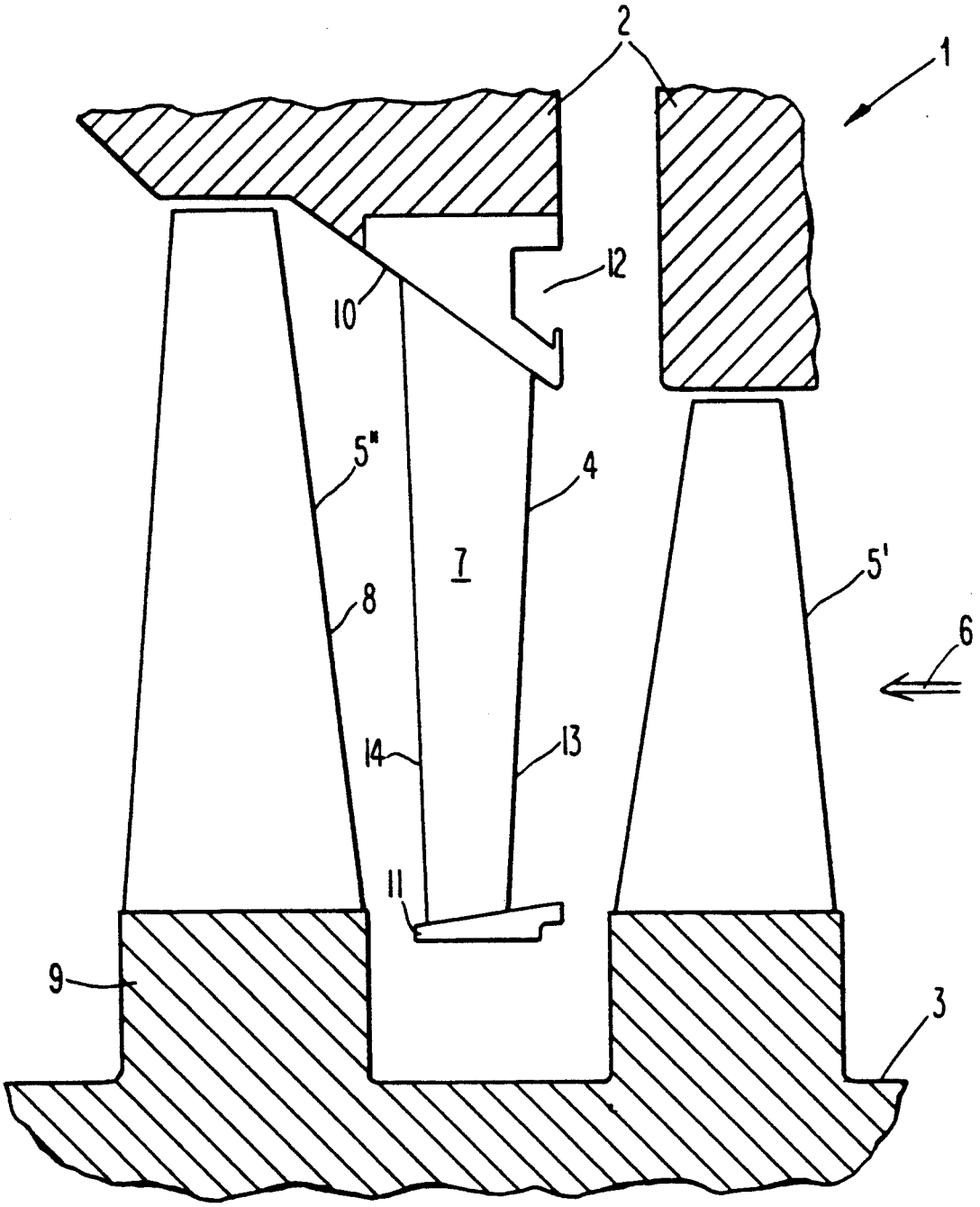
FIG. 1 is a portion of a cross-section through a steam turbine in the vicinity of the stage containing the last row of vanes according to the current invention.

Referring to the drawings, there is shown in FIG. 1 a portion of a cross-section through the low pressure section of a steam turbine 1. As shown, the steam flow path of the steam turbine 1 is formed by a stationary cylinder 2 and a rotor 3, the axis of rotation of the rotor defining the axial direction. Rows of blades 5' and 5" are attached to the periphery of the rotor 3 and extend radially outward into the flow path in a circumferential array. A row of vanes 4 are attached to the cylinder 2 and extend radially inward in a circumferential array. The vanes 4 are positioned between the upstream and downstream blades 5' and 5", respectively. The vanes 4 receive the steam flow 6 from the upstream blades 5' and direct it to the downstream row of blades 5" so that the steam enters the row of blades 5" at the correct angle. The row of vanes 4 and the row of blades 5" together form a stage that, in the preferred embodiment of the invention, is the last stage—that is, the downstream-most stage—in the turbine. The vane for this last stage is designated L-0C. The vanes 4 are manufactured by a forging process and are installed into the turbine 1 as segmental assemblies.

As shown in FIG. 1, each blade 5" is comprised of an airfoil portion 8 that extracts energy from the steam 6 and a root portion 9 that serves to fix the blade to the rotor 3. Each vane 4 has an outer shroud 10, by which it is affixed to the cylinder 2, an inner shroud 11, and an airfoil portion 7 extending in the radial direction between the inner and outer shrouds. The airfoil 7 has a leading edge 13 and a trailing edge 14. In the preferred embodiment, the outer shroud 10 has a moisture removal slot 12 formed in its upstream face.

Figure 2:
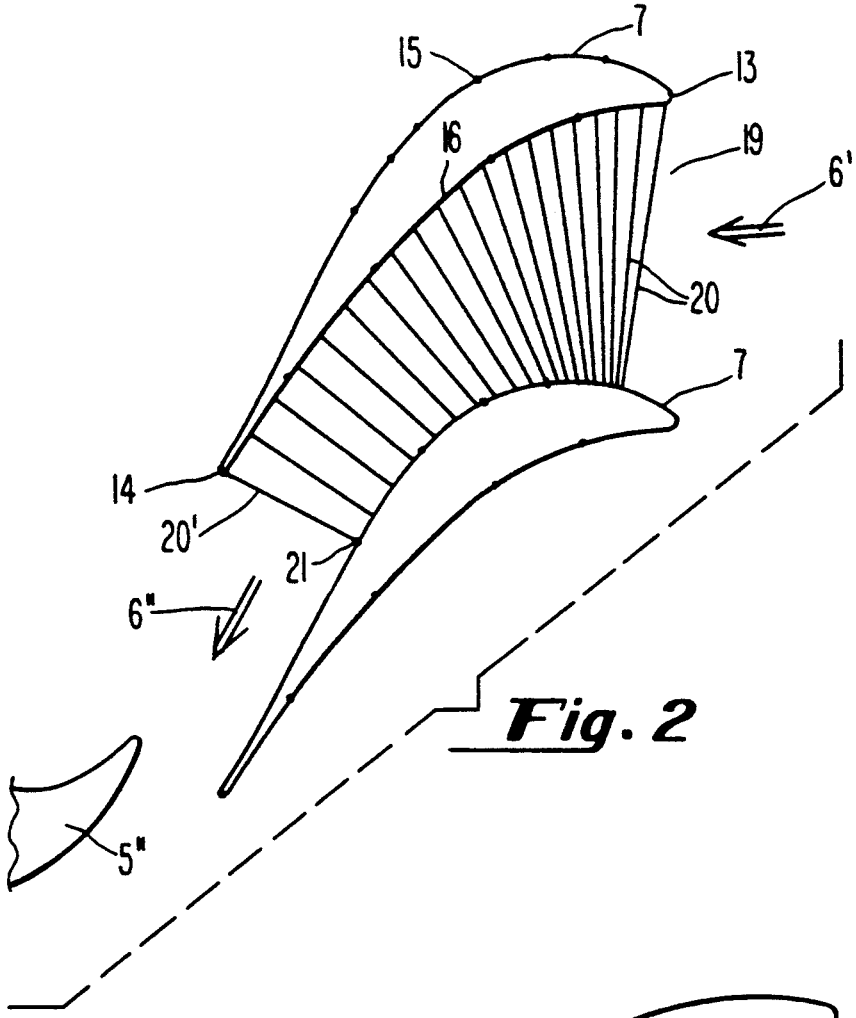
FIG. 2 is a diagram of two adjacent airfoils according to the current invention illustrating convergence of the passage between the airfoils.

The current invention concerns the airfoil 7 of the vanes 4. More specifically, the current invention concerns a novel vane airfoil shape that provides sufficient thickness in the trailing edge region of the airfoil to prevent distortion during the forging process but that minimizes the losses that the steam 6 flowing through the row of vanes 4 experiences, thereby increasing the performance of the vane and the thermodynamic efficiency of the turbine. Accordingly, FIG. 2 shows two adjacent vane airfoils 7 that form a portion of the vane row. Each airfoil 7 has a convex suction surface 15 and a concave pressure surface 16 formed between the leading and trailing edges 13 and 14, respectively. The novel geometry of the airfoil 7 for the L-0C vane of the current invention is shown in FIGS. 3 and 4 and specified in Tables I and II.

Figure 3:
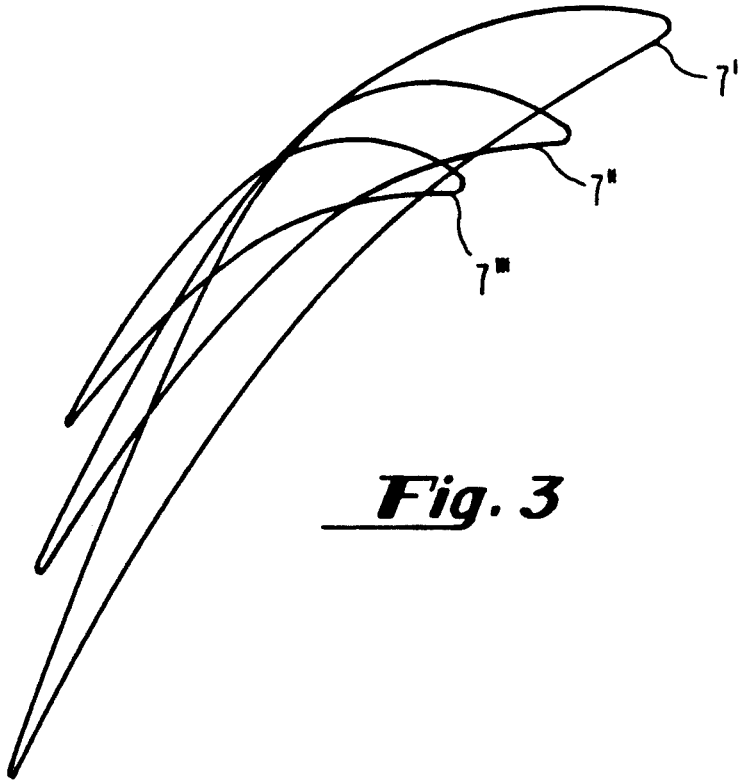
FIG. 3 is a series of transverse cross-sections through the airfoil shown in FIG. 1 at various radial locations superimposed on one another.

FIG. 3 is a so-called "stacked plot" of the airfoil shape—that is, the shape of the airfoil cross-sections at three radial heights superimposed on one another as they would be if projected onto a plane perpendicular to the radial direction. The cross-section proximate the outer shroud 10 is indicated by 7', the cross-section at mid-height—that is, mid way between the outer shroud 10 and the inner shroud 11 at the trailing edge 14—is indicated by 7", and the cross-section proximate the inner shroud 11 is indicated 7'", FIG. 4 shows the mid-height cross-sectional shape 7" of the airfoil 7 plotted on coordinate axes X and Y, with X being the axial direction and Y being the transverse direction. The units indicated on the X axis refer to the percentage of the airfoil axial width W, the axial width being the distance from the leading 13 to the trailing 14 edge in the axial direction. The values of the curvature 17 along the suction surface 15 and the curvature 18 along the pressure surface 16, discussed further below, are also shown in FIG. 4.

Figure 4:
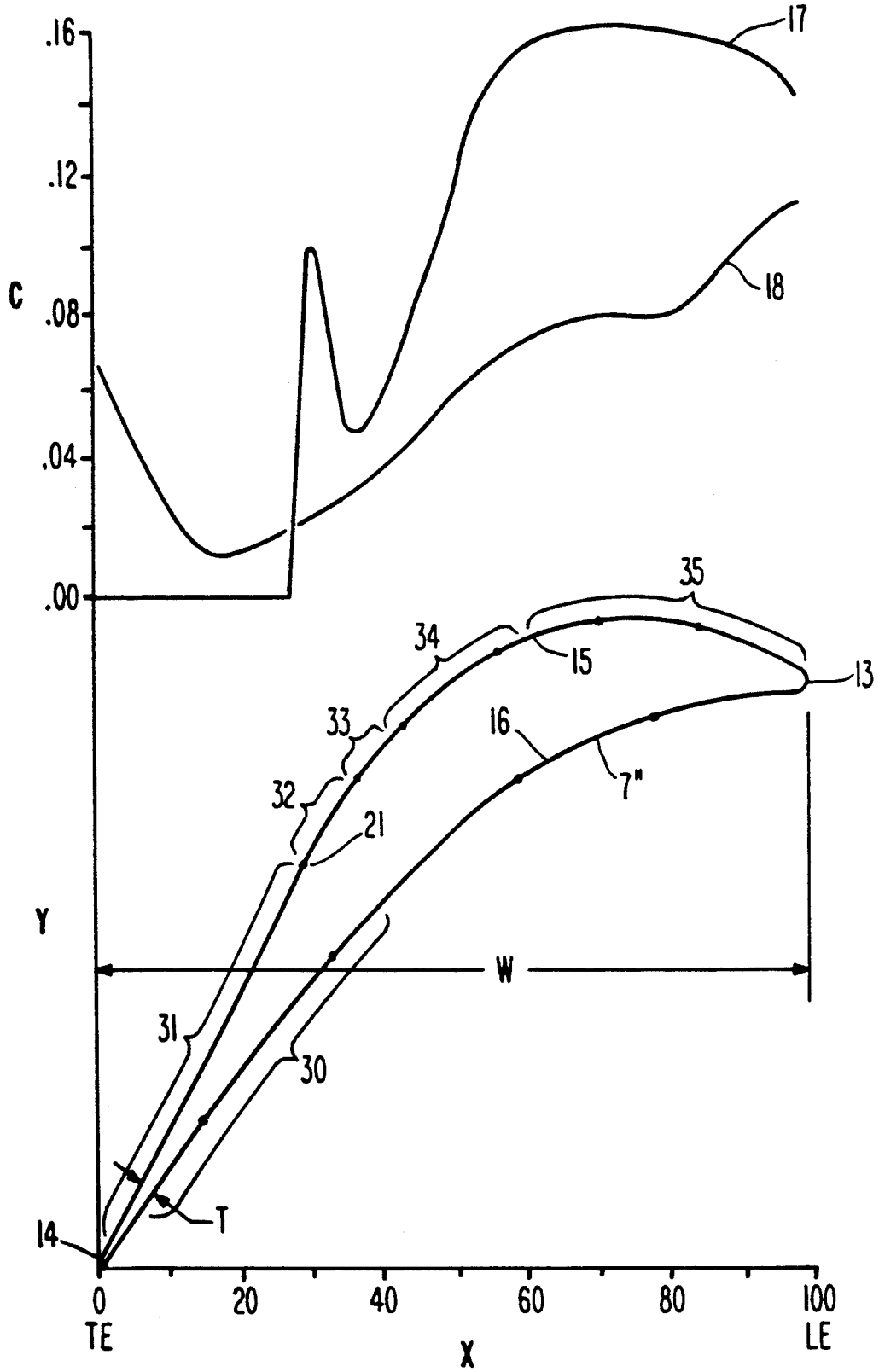
FIG. 4 is a cross-section of the airfoil shown in FIG. 1 at approximately mid-height superimposed on a graph of the curvature of the suction and pressure surfaces of the airfoil versus the percentage of the airfoil axial width.

Tables I and II give the coordinates, with respect to the coordinate axes X and Y shown in FIG. 4, of forty two points along the suction and pressure surfaces of the airfoil that define the shape of the airfoil cross-section 7" at mid-height. The slope and curvature of the surfaces at each coordinate point are also indicated in the tables. As used herein, curvature is defined as the inverse of the radius of curvature of the particular portion of the airfoil surface and is expressed as $cm^{-1}$. Although the location coordinates shown in Tables I and II define an airfoil of a particular size, it is clear that the invention could be practiced utilizing a larger or smaller airfoil having the same mid-height shape by appropriately scaling the coordinates so as to obtain multiples or fractions thereof—i.e., by multiplying each coordinate by a common factor.

TABLE I (Suction Surface)

| Location No. | Coordinates (cm, cm) | Slope | Curvature $cm^{-1}$ |
|---|---|---|---|
| 1 | (0.00, 1.30) | 1.97 | 0.0 |
| 2 | (0.91, 1.93) | 1.97 | 0.0 |
| 3 | (1.83, 3.71) | 1.97 | 0.0 |
| 4 | (2.74, 5.51) | 1.97 | 0.0 |
| 5 | (3.66, 7.32) | 1.97 | 0.0 |
| 6 | (4.57, 9.12) | 1.97 | 0.0 |
| 7 | (5.03, 9.96) | 1.67 | 0.100 |
| 8 | (5.49, 10.64) | 1.42 | 0.073 |
| 9 | (5.94, 11.28) | 1.29 | 0.048 |
| 10 | (6.40, 11.84) | 1.19 | 0.056 |
| 11 | (7.32, 12.83) | 1.00 | 0.082 |
| 12 | (8.20, 13.64) | 0.78 | 0.120 |
| 13 | (9.14, 14.25) | 0.56 | 0.147 |
| 14 | (10.06, 14.68) | 0.37 | 0.160 |
| 15 | (10.97, 14.94) | 0.21 | 0.162 |
| 16 | (11.86, 15.06) | 0.05 | 0.161 |
| 17 | (12.78, 15.04) | −0.09 | 0.163 |
| 18 | (13.69, 14.88) | −0.25 | 0.160 |
| 19 | (14.61, 14.61) | −0.41 | 0.157 |
| 20 | (15.52, 14.12) | −0.61 | 0.150 |
| 21 | (15.98, 13.82) | −0.73 | 0.141 |

TABLE II (Pressure Surface)

| Location No. | Coordinates (cm, cm) | Slope | Curvature $cm^{-1}$ |
|---|---|---|---|
| 22 | (0.18, 0.05) | 1.97 | 0.065 |
| 23 | (1.07, 1.60) | 1.57 | 0.041 |
| 24 | (1.96, 2.92) | 1.42 | 0.019 |
| 25 | (2.84, 4.17) | 1.37 | 0.011 |
| 26 | (3.73, 5.36) | 1.31 | 0.016 |
| 27 | (4.62, 6.50) | 1.24 | 0.021 |
| 28 | (5.08, 7.06) | 1.20 | 0.023 |
| 29 | (5.54, 7.57) | 1.16 | 0.027 |
| 30 | (5.97, 8.08) | 1.11 | 0.033 |
| 31 | (6.43, 8.59) | 1.06 | 0.039 |
| 32 | (7.32, 9.47) | 0.95 | 0.051 |
| 33 | (8.20, 10.26) | 0.83 | 0.062 |
| 34 | (9.09, 10.95) | 0.71 | 0.071 |
| 35 | (9.98, 11.53) | 0.60 | 0.076 |
| 36 | (10.87, 12.01) | 0.49 | 0.078 |
| 37 | (11.78, 12.40) | 0.40 | 0.079 |
| 38 | (12.67, 12.73) | 0.32 | 0.078 |
| 39 | (13.56, 12.98) | 0.23 | 0.090 |
| 40 | (14.45, 13.16) | 0.14 | 0.101 |
| 41 | (15.34, 13.23) | 0.05 | 0.110 |
| 42 | (15.80, 13.26) | 0.02 | 0.112 |

As can be seen in FIG. 3, as is typical of many steam turbine blades, the shape of the airfoil cross-section changes along its radial height. Thus, those of skill in the art will appreciate that the invention can be practiced using airfoils having generally the same shape as that defined in Tables I and II and shown in FIG. 4 but which have been rotated and scaled to obtain differing stagger angles and slopes while keeping the amount of turning approximately the same.

In addition, the invention can be practiced using airfoils with substantially greater or lesser amounts of turning than that of the airfoil cross-section 7" shown in FIG. 4 by approximately scaling the values of the location coordinates and curvature given in Tables I and II.

As shown in FIG. 2, each pair of adjacent airfoils 7 form a passage 19 therebetween that serves to direct the flow of steam 6' entering the vane row so that the steam 6" exiting the row has been turned at the proper angle to be received by the row of downstream blades 5". As previously discussed, in order to avoid separation of the steam 6 as it flows along the airfoil surfaces, airfoil 7 of the current invention is shaped so that the distance between the suction and pressure surfaces 16 and 17, respectively, of adjacent airfoils constantly decreases from the leading edge 13 to the throat 20' of the passage 19. The distance between airfoil 7 defining the passage 19 are indicated by the lines 20 in FIG. 2.

As shown in FIG. 2, the throat 20' of the passage 19 is defined by the minimum distance between the adjacent airfoil 7 surfaces and occurs at the trailing edge 14 on the pressure surface 16 and at location 21 on the suction surface 15. The "gauging" of the vane row—defined as the ratio of the throat to the vane pitch—is an important parameter because it indicates the percentage of the annular area available for steam flow. Accordingly, location 21 on the suction surface 15 that defines the throat 20' is often referred to as the "gauging point."

Figure 5:
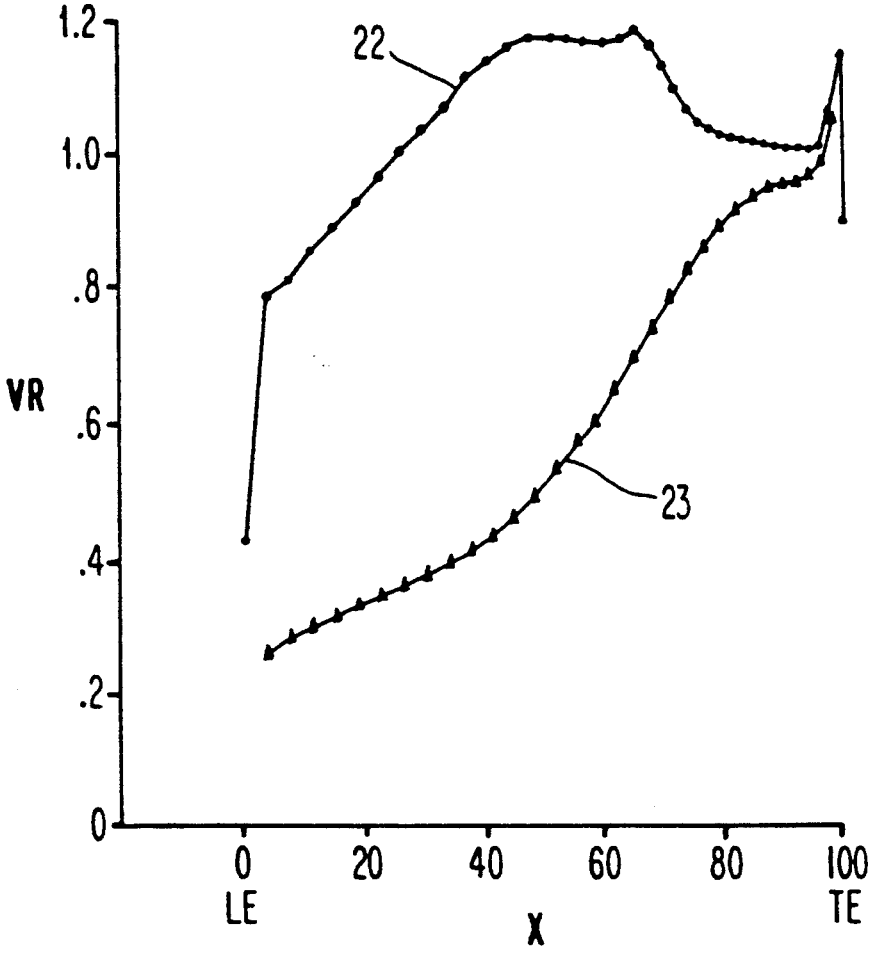
FIG. 5 is a graph showing the calculated axial distribution of the steam velocity ratio—that is, the local surface velocity to the vane row exit velocity—along the width of the airfoil, from the leading edge LE to the trailing edge TE, over the airfoil suction surface, upper curve, and the airfoil pressure surface, lower curve, at approximately mid-height.

As previously discussed, the major loss in the vane row, other than due to steam flow separation, occurs due to friction losses as the steam 6 flows over the airfoil surfaces. Thus, in the vane airfoil 7 according to the current invention, friction losses are minimized by configuring the airfoil shape so as to maintain the velocity of the steam at relatively low values, as shown in FIG. 5. Specifically, FIG. 5 shows that the variation in the velocity ratio VR—that is, the variation in the ratio of the steam velocity at the surface of the airfoil at mid-height to the velocity of the steam exiting the vane row at mid-height—versus the axial width of the airfoil, expressed as a percent of the total airfoil axial width W, from the leading edge LE to the trailing edge TE. Curve 22 indicates the velocity ratio on the suction surface 15 and curve 23 indicates the velocity ratio on the pressure surface 16. As can be seen, the velocity ratio VR along the entire width of the airfoil is less than 1.2. Such advantageous velocity profiles are made possible by the novel vane airfoil surface contour according to the current invention, as shown in FIGS. 2-4 and Tables I and II.

As previously discussed, if the thickness T of the airfoil 7 in the trailing edge 14 region, shown in FIG. 4, is too thin, the forging process by which the vane 4 is manufactured will produce distortion in the airfoil shape. In the preferred embodiment, the airfoil has a thickness of approximately 0.340 cm (0.134 inch) at a point approximately 2.5 cm (1.0 inch) upstream from the trailing edge 14 to ensure that no distortion will occur. According to the current invention, the trailing edge region has been thickened in a novel way—i.e., by straightening out the portion of the pressure surface 16 upstream of the trailing edge 14.

Curve 18 of FIG. 4 shows the novel shape of the pressure surface 16. Specifically, the curvature C of the pressure surface 16 in a region 30, beginning at a distance upstream from the trailing edge 14 by approximately 5% of the airfoil axial width W and ending at a distance upstream from the trailing edge 14 by approximately 40% of the airfoil axial width, is substantially straight—i.e., less than approximately 0.04 $cm^{-1}$ curvature throughout the region. In fact, the pressure surface 16 curvature in a portion of region 30, beginning at a distance upstream from the trailing edge 14 by approximately 12% of the airfoil width and ending at a distance upstream from the trailing edge 14 by approximately 30% of the airfoil axial width, is less than 0.02 $cm^{-1}$ curvature. This straight region 30 of the pressure surface 16 curvature increases the thickness T of the airfoil 7 in the trailing edge 14 region.

In airfoils having conventional suction surface 15 shapes, such straightening of the pressure surface 16 in the trailing edge 14 region would result in a loss of convergence in the airfoil passage 19, thereby creating the potential for steam flow separation and its attendant losses. However, this problem is prevented in the current invention by imparting a novel shape to the suction surface 15, as well as the pressure surface 16.

Curve 17 of FIG. 4 shows the novel shape of the suction surface 15. As shown therein, the curvature of the suction surface 15 in a region 31 beginning at the trailing edge 14 and ending at the gauging point 21—i.e., ending at a distance upstream from the trailing edge 14 by approximately 28% of the airfoil axial width W—is essentially straight, having a curvature of less than approximately 0.001 $cm^{-1}$ throughout the region. This is sometimes referred to as the "flatback" region of the suction surface and contributes to performance in transonic flow.

However, a region 32, immediately upstream of region 31 has a high curvature—i.e., greater than approximately 0.08 $cm^{-1}$ curvature throughout a portion of the suction surface 15 beginning at a distance upstream from the trailing edge 14 by approximately 30% of the airfoil axial width W and ending at a distance upstream from the trailing edge by approximately 34% of the airfoil axial width. In fact, the curvature in region 32 reaches a maximum of approximately 0.10 $cm^{-1}$ curvature at a distance upstream from the trailing edge 14 of approximately 31% of the airfoil axial width.

In a region 33, immediately upstream of region 32, the curvature dramatically decreases—i.e., to less than approximately 0.06 $cm^{-1}$ curvature throughout a portion of the suction surface 15 beginning at distance upstream from the trailing edge 14 by approximately 36% of the airfoil axial width W and ending at a distance upstream from the trailing edge by approximately 41% of the airfoil axial width. In fact, the curvature in region 33 reaches a minimum of approximately 0.05 $cm^{-1}$ curvature at a distance upstream from the trailing edge 14 by approximately 38% of the airfoil axial width.

In region 34, immediately upstream of region 33, the curvature increases constantly as the suction surface progresses beginning at a distance upstream from the trailing edge 14 by approximately 41% of the axial width W to a maximum curvature of approximately 0.16 $cm^{-1}$ at a distance upstream from the trailing edge by approximately 60% of the airfoil axial width.

In region 35, immediately upstream of region 34 and ending at the leading edge 13—i.e, the upstream-most 40% of the airfoil axial width W—the curvature remains in the approximately 0.14 to 0.16 $cm^{-1}$ range throughout the region.

Thus, in the airfoil according to the current invention, the curvature in the region 30 of the pressure surface 16 proximate the trailing edge 14 has been straightened to increase the thickness T of the airfoil 7 in the trailing edge region, as shown in FIG. 4, so as to preclude distortion during forging. Despite this straightening, convergence of the passage 19 has been maintained, as indicated in FIG. 2, and relatively low values of velocity ratio have been attained, as indicated in FIG. 5, by the novel shaping the suction surface 15, as shown in FIG. 4.

The novel shaping of the suction surface 15 is such that the region 31 of the suction surface 15 downstream of the gauging point 21, comprising approximately the downstream-most 30% of the airfoil axial width W, is essentially straight. Traveling in the upstream direction, the essentially straight region 31 is followed by the region 32, upstream of the gauging point 21 that has a large amount of curvature and comprises approximately 5% of the airfoil axial width W immediately upstream from the region 31. The large amount of curvature in region 32 maintains convergence immediately upstream on the throat and is necessary due to the straightness of region 30 on the pressure surface 16.

Region 32 is followed by the region 33 that has a lower curvature than region 32 and comprises approximately 5% of the airfoil axial width W immediately upstream from the region 32. The smaller curvature of region 33 reduces the velocity ratio to values less than 1.2, as shown in FIG. 5. Region 33 is followed by the region 34 of constantly increasing curvature that increases to a curvature greater than the curvature of region 32 and that comprises approximately 20% of the airfoil axial width W immediately upstream from the region 33. The gradual constantly increasing curvature of region 34 also helps to keep the velocity ratios low. Region 34 is followed by the region 35, ending at the leading edge 13, of essentially constant large curvature that includes the maximum curvature throughout the suction surface 15 and that comprises approximately 40% of the airfoil axial width W immediately upstream from the region 34. As a result of this shaping, most of the curvature in the suction surface 15 occurs in the upstream-most 60% of the suction surface, a region defined by two segments 34 and 35 of constantly increasing and essentially constant, respectively curvature.

Although the present invention has been illustrated with respect to a last row vane in a steam turbine, the invention may be utilized in other vane rows of a steam turbine as well. Accordingly, the present invention may be embodied in other specific forms without departing from the spirit or essential attributes thereof and, accordingly, reference should be made to the appended claims, rather than to the foregoing specification, as indicating the scope of the invention.

I claim:

1. A steam turbine comprising:

a) a stationary cylinder for containing a steam flow, and a rotor enclosed by said cylinder;

b) a row of blades attached to the periphery of said rotor; and c) a row of vanes supported on said cylinder and disposed upstream of said row of blades, each of said vanes having an airfoil portion having leading and trailing edges and forming a suction surface and a pressure surface between said leading and trailing edges, said airfoil portion having a width in the axial direction and having a cross-sectional shape that, in conjunction with said trailing edge of an adjacent one of said vanes in said row, defines a gauging point on said suction surface, said pressure surface having a cross-sectional shape in at least one radial location along said airfoil that has a substantially flat portion that extends upstream from said trailing edge by a distance of at least approximately 40% of said airfoil axial width, said suction surface having a cross-sectional shape in said at least one radial location along said airfoil that has:

(i) a substantially flat first portion forming all of said suction surface that is downstream of said gauging point, (ii) a curved section portion upstream of said gauging point, said second portion having a first curvature, (iii) a second curvature along a third portion upstream of said second portion, said second curvature being less than said first curvature, and (iv) a third curvature along a fourth portion upstream of said third portion and ending at said leading edge, said third curvature being greater than said second curvature.

2. The steam turbine according to claim 1, wherein said third curvature is the maximum curvature on said suction surface.

3. The steam turbine according to claim 1, wherein said first portion of said suction surface comprises the downstream-most approximately 30% of said axial width of said airfoil.

4. The steam turbine according to claim 1, wherein said fourth portion of said suction surface has an upstream segment and a downstream segment, said downstream segment having a curvature that constantly increases as said downstream segment progresses in the upstream direction toward said upstream segment, and said upstream segment having a curvature that is substantially constant throughout said upstream segment.

5. The steam turbine according to claim 1, wherein said first portion of said suction surface comprises a region that is approximately the downstream-most 30% of said airfoil axial width, said second portion of said suction surface comprises a region that is approximately 5% of said airfoil axial width and is immediately upstream from said first portion, said third portion of said suction surface comprises a region that is approximately 5% of said airfoil axial width and is immediately upstream from said second portion, and said fourth portion comprises a region of approximately 60% of said airfoil axial width and that is immediately upstream of said third portion.

6. The steam turbine according to claim 1, wherein said airfoil suction surface shape is defined by coordinate locations expressed as distances from said trailing edge in the axial and transverse directions, respectively, as follows:

| Location No. | Coordinates |
|---|---|
| 1 | (0.00, 1.30) |
| 2 | (0.91, 1.93) |
| 3 | (1.83, 3.71) |
| 4 | (2.74, 5.51) |
| 5 | (3.66, 7.32) |
| 6 | (4.57, 9.12) |
| 7 | (5.03, 9.96) |

-continued

| Location No. | Coordinates |
|---|---|
| 8 | (5.49, 10.64) |
| 9 | (5.94, 11.28) |
| 10 | (6.40, 11.84) |
| 11 | (7.32, 12.83) |
| 12 | (8.20, 13.64) |
| 13 | (9.14, 14.25) |
| 14 | (10.06, 14.68) |
| 15 | (10.97, 14.94) |
| 16 | (11.86, 15.06) |
| 17 | (12.78, 15.04) |
| 18 | (13.69, 14.88) |
| 19 | (14.61, 14.61) |
| 20 | (15.52, 14.12) |
| 21 | (15.98, 13.82) |

7. The steam turbine according to claim 6, wherein said airfoil suction surface shape has a curvature, expressed as $cm^{-1}$, at said locations, as follows:

| Location No. | Curvature |
|---|---|
| 1 | 0.0 |
| 2 | 0.0 |
| 3 | 0.0 |
| 4 | 0.0 |
| 5 | 0.0 |
| 6 | 0.0 |
| 7 | 0.100 |
| 8 | 0.073 |
| 9 | 0.048 |
| 10 | 0.056 |
| 11 | 0.082 |
| 12 | 0.120 |
| 13 | 0.147 |
| 14 | 0.160 |
| 15 | 0.162 |
| 16 | 0.161 |
| 17 | 0.163 |
| 18 | 0.160 |
| 19 | 0.157 |
| 20 | 0.150 |
| 21 | 0.141 |

8. A row of stationary vanes for a steam turbine, each of said vanes comprising an airfoil portion having leading and trailing edges and forming a suction surface and a pressure surface between said leading and trailing edges, said airfoil portion having a cross-sectional shape that, in conjunction with said trailing edge of an adjacent one of said vanes in said row, defines a gauging point on said suction side, said pressure surface having a cross-sectional shape in at least one radial location along said airfoil that has a substantially flat region proximate said trailing edge and a curved region upstream of said flat region, said flat region extending tangentially from said curved region, said suction surface having a cross-sectional shape in said at least one radial location along said airfoil that has:

a) a substantially flat first portion forming all of said suction surface that is downstream of said gauging point;

b) a first curvature along a second portion of said suction side upstream of said gauging point;

c) a second curvature along a third portion of said suction surface upstream of said second portion, said second curvature being less than said first curvature; and d) a third curvature along a fourth portion of said suction surface upstream of said third portion, said third curvature being greater than said second curvature.

9. The steam turbine vane according to claim 8, wherein said third curvature is greater than said first curvature.

10. The steam turbine vane according to claim 8, wherein said airfoil suction surface shape is defined by coordinate locations expressed as distances from said trailing edge in the axial and transverse directions, respectively, as follows:

| Location No. | Coordinates |
|---|---|
| 1 | (0.00, 1.30) |
| 2 | (0.91, 1.93) |
| 3 | (1.83, 3.71) |
| 4 | (2.74, 5.51) |
| 5 | (3.66, 7.32) |
| 6 | (4.57, 9.12) |
| 7 | (5.03, 9.96) |
| 8 | (5.49, 10.64) |
| 9 | (5.94, 11.28) |
| 10 | (6.40, 11.84) |
| 11 | (7.32, 12.83) |
| 12 | (8.20, 13.64) |
| 13 | (9.14, 14.25) |
| 14 | (10.06, 14.68) |
| 15 | (10.97, 14.94) |
| 16 | (11.86, 15.06) |
| 17 | (12.78, 15.04) |
| 18 | (13.69, 14.88) |
| 19 | (14.61, 14.61) |
| 20 | (15.52, 14.12) |
| 21 | (15.98, 13.82) |

11. The steam turbine vane according to claim 10, wherein said airfoil pressure surface shape is defined by coordinate locations expressed as distances from said trailing edge in the axial and transverse directions, respectively, as follows:

| Location No. | Coordinates |
|---|---|
| 22 | (0.18, 0.05) |
| 23 | (1.07, 1.60) |
| 24 | (1.96, 2.92) |
| 25 | (2.84, 4.17) |
| 26 | (3.73, 5.36) |
| 27 | (4.62, 6.50) |
| 28 | (5.08, 7.06) |
| 29 | (5.54, 7.57) |
| 30 | (5.97, 8.08) |
| 31 | (6.43, 8.59) |
| 32 | (7.32, 9.47) |
| 33 | (8.20, 10.26) |
| 34 | (9.09, 10.95) |
| 35 | (9.98, 11.53) |
| 36 | (10.87, 12.01) |
| 37 | (11.78, 12.40) |
| 38 | (12.67, 12.73) |
| 39 | (13.56, 12.98) |
| 40 | (14.45, 13.16) |
| 41 | (15.34, 13.23) |
| 42 | (15.80, 13.26) |

12. A stationary vane for a steam turbine, comprising an airfoil portion having leading and trailing edges and forming a suction surface and a pressure surface between said leading and trailing edges, said airfoil having a width in the axial direction, and said suction surface having a cross-sectional shape in at least one radial location along said airfoil that has:

a) a substantially downstream-most first portion that is substantially flat;

b) a second portion immediately upstream of said first portion having a maximum curvature in the range of approximately 0.08 to 0.10 $cm^{-1}$;

c) a third portion immediately upstream of said second portion having a minimum curvature in the range of approximately 0.05 to 0.06 $cm^{-1}$; and d) a fourth portion immediately upstream of said third portion and extending to said leading edge and having a maximum curvature in the range of approximately 0.15 to 0.17 $cm^{-1}$.

13. The steam turbine vane according to claim 12, wherein said fourth portion has first and second segments, said first segment being immediately upstream of said third portion and having a radius of curvature that constantly increases as said suction surfaces progresses in the upstream direction to a maximum curvature in the range of approximately 0.15 to 0.17 $cm^{-1}$.

14. The steam turbine vane according to claim 13, wherein said second segment of said fourth portion is immediately upstream of said first segment of said fourth portion and has a radius of curvature that is in the range of approximately 0.15 to 0.17 $cm^{-1}$ throughout said second segment.

15. The steam turbine vane according to claim 12, wherein said first portion comprises approximately 30% of said airfoil width in the axial direction.

16. The steam turbine vane according to claim 15, wherein said second portion comprises approximately 5% of said airfoil width in the axial direction.

17. The steam turbine vane according to claim 16, wherein said third portion comprises approximately 5% of said airfoil width in the axial direction, and wherein said fourth portion comprises approximately 60% of said airfoil width in the axial direction.

* * * * *